US009055640B2

(12) United States Patent
Park et al.

(10) Patent No.: US 9,055,640 B2
(45) Date of Patent: Jun. 9, 2015

(54) LIGHT EMITTING DIODE DRIVING APPARATUS

(75) Inventors: Jung Eui Park, Gyunggi-do (KR); Bo Hyun Hwang, Gyunggi-do (KR); Seo Hyung Kim, Gyunggi-do (KR); Jae Shin Lee, Gyunggi-do (KR); Dae Hoon Han, Gyunggi-do (KR); Seung Kon Kong, Gyunggi-do (KR)

(73) Assignee: SAMSUNG ELECTRO-MECHANICS CO., LTD., Suwon, Gyunggi-Do (KR)

( * ) Notice: Subject to any disclaimer, the term of this patent is extended or adjusted under 35 U.S.C. 154(b) by 344 days.

(21) Appl. No.: 13/494,543

(22) Filed: Jun. 12, 2012

(65) Prior Publication Data

US 2013/0249418 A1 Sep. 26, 2013

(30) Foreign Application Priority Data

Mar. 21, 2012 (KR) ..... 10-2012-0029002

(51) Int. Cl.
*H05B 33/08* (2006.01)

(52) U.S. Cl.
CPC ..... *H05B 33/0827* (2013.01)

(58) Field of Classification Search
USPC ..... 315/186
See application file for complete search history.

(56) References Cited

U.S. PATENT DOCUMENTS

| | | | | |
|---|---|---|---|---|
| 7,923,943 | B2 * | 4/2011 | Peker et al. | 315/312 |
| 2006/0001381 | A1 * | 1/2006 | Robinson et al. | 315/185 R |
| 2009/0085489 | A1 * | 4/2009 | Chang et al. | 315/193 |
| 2009/0230891 | A1 * | 9/2009 | Zhao et al. | 315/308 |
| 2010/0327772 | A1 * | 12/2010 | Lee et al. | 315/297 |
| 2011/0012521 | A1 * | 1/2011 | Byun et al. | 315/186 |
| 2011/0031898 | A1 * | 2/2011 | Lin et al. | 315/297 |
| 2011/0062872 | A1 | 3/2011 | Jin et al. | |
| 2011/0248648 | A1 * | 10/2011 | Liu | 315/294 |
| 2011/0309758 | A1 | 12/2011 | Yu et al. | |
| 2013/0009557 | A1 * | 1/2013 | Szczeszynski | 315/186 |

FOREIGN PATENT DOCUMENTS

| | | |
|---|---|---|
| JP | 2006-172806 | 6/2006 |
| JP | 2008-186668 A | 8/2008 |
| KR | 10-2012-0008004 A | 1/2012 |

OTHER PUBLICATIONS

Office Action Korean Patent Application No. 10-2012-0029002 dated Jul. 29, 2013 with English translation thereof.

* cited by examiner

*Primary Examiner* — Douglas W Owens
*Assistant Examiner* — Monica C King
(74) *Attorney, Agent, or Firm* — McDermott Will & Emery LLP

(57) ABSTRACT

There is provided a light emitting diode driving apparatus capable of uniformly maintaining current balance between light emitting diode channels. The light emitting diode driving apparatus includes: a DC to DC converting unit converting the direct current power into settable driving power; a detecting unit detecting voltage drops generated in each of a plurality of light emitting diode channels each having a plurality of light emitting diodes; a converting unit converting an analog value into a digital value; and a driving unit differentially setting duty cycles of switching signals according to the digital values from the converting unit to drive the plurality of light emitting diode channels.

24 Claims, 4 Drawing Sheets

LIGHT EMITTING DIODE DRIVING APPARATUS

CROSS-REFERENCE TO RELATED APPLICATIONS

This application claims the priority of Korean Patent Application No. 10-2012-0029002 filed on Mar. 21, 2012, in the Korean Intellectual Property Office, the disclosure of which is incorporated herein by reference.

BACKGROUND OF THE INVENTION

1. Field of the Invention

The present invention relates to a light emitting diode driving apparatus capable of maintaining a uniform current balance between light emitting diode channels.

2. Description of the Related Art

Recently, interest in and a demand for light emitting diodes (LEDs) has increased.

Since a device using a light emitting diode may be manufactured to be compact, it may be used even in a location in which it is difficult for an existing electronic product to be installed. In the case in which a device using the light emitting diode is used as a general lighting device, since light of varied colors and illumination intensities may easily be implemented in a device using the light emitting diode, it may be used in a lighting device or system suitable for use in a situation such as displaying a movie, reading a book, holding a meeting, or the like.

In addition, a lighting device or system using the light emitting diode consumes an amount of power corresponding to ⅛ of that consumed by an incandescent lamp, has a lifespan of 50 to 100 thousand hours, corresponding to a lifespan 5 to 10 times that of an incandescent lamp, is a mercury-free light source, is environmentally-friendly, and may be variably implemented.

Due to these characteristics, a light emitting diode lighting business has been promoted through national policy initiatives in countries such as Korea, the USA, Japan, Australia, and others.

Moreover, in accordance with the recent development of flat panel display technology, a flat panel display has also been used for automobile dashboard displays, as well as for smart phones, game machines, and digital cameras. In the future, the use of flat panel displays is projected to increase in fields related to personal life, such as in ultrathin-type televisions, transparent navigation devices, and the like. Further, in the current display field, new flat panel displays (FPDs), reflecting the requirements of the multimedia age, such as high resolution, large screens, and the like, have mainly been developed. Particularly, in the case of a large display, a liquid crystal display (LCD) TV has rapidly been developed, such that it will be expected that LCDs will play a leading role in the development of many products in view of the cost and marketability thereof in the future.

A thin film transistor liquid crystal display (TFT-LCD) is mainly used in a flat panel display. The TFT-LCD includes a backlight unit emitting light, and mainly uses a cold cathode fluorescent lamp (CCFL) as a backlight light source. However, recently, the use of a light emitting diode (LED) has been gradually increased due to various strengths such as low power consumption, long lifespan, environmental-friendliness characteristics, and the like. Therefore, a configuration of a low-cost and low-power electronics system for a backlight unit power module using an LED and an appropriate controlling element therefore have been urgently demanded.

As described above, a light emitting diode that tends to be increasingly used requires a driving apparatus for driving the light emitting diode. According to the related art, a switching element has mainly been used in order to control respective LED channels with a constant current. However, as disclosed in the following related art document, since respective LED channels are configured to include a plurality of LEDs connected in series, thereby causing a voltage deviation between the LEDs, current unbalance is generated between the LED channels, such that brightness of the light emitting diode driving apparatus may not be uniform.

RELATED ART DOCUMENT

US Patent Application Publication No. US 2011/0309758

SUMMARY OF THE INVENTION

An aspect of the present invention provides a light emitting diode (LED) driving apparatus capable of differentially setting duty cycles in which driving current is allowed to flow in respective LED channels according to a voltage deviation between the LED channels in order to reduce heat generated due to voltage deviations between the LED channels.

According to an aspect of the present invention, there is provided a light emitting diode driving apparatus, including: an alternating current to direct current converting unit converting input alternating current power into direct current power having a preset voltage level; a direct current to direct current converting unit converting the direct current power into settable driving power; a detecting unit detecting voltage drops generated in a plurality of respective light emitting diode channels each having a plurality of light emitting diodes performing a light emitting operation by receiving the driving power; a converting unit converting an analog value detected by the detecting unit into a digital value; and a driving unit differentially setting duty cycles of switching signals by which driving current is allowed to flow in the plurality of respective light emitting diode channels according to the digital values from the converting unit to drive the plurality of light emitting diode channels.

The detecting unit may include a plurality of detectors respectively corresponding to the plurality of light emitting diode channels and detecting the voltage drops in a corresponding light emitting diode channel.

The driving unit may include a plurality of drivers respectively corresponding to the plurality of light emitting diode channels and setting the duty cycles of the switching signals in which the driving current is allowed to flow in a corresponding light emitting diode channel to thereby be driven.

The converting unit may include a plurality of converters respectively corresponding to the plurality of detectors and converting the analog value detected by each of the plurality of detectors into the digital value to transfer the converted digital value to a corresponding driver among the plurality of drivers.

The driving unit may set a switching-on duty cycle so as to be long when the voltage drop exceeds a reference voltage and the switching-on duty cycle so as to be shortened when the voltage drop is lower than the reference voltage.

The detecting unit, the converting unit, and the driving unit may be configured by at least one integrated circuit.

The light emitting diode driving apparatus may further include a plurality of switches respectively connected between each of the plurality of light emitting diode channels and a ground, and turned on and turned off according to the switching duty cycle set by the driving unit to drive the corresponding light emitting diode channel.

The light emitting diode driving apparatus may further include a plurality of buffers buffering a switching duty cycle signal from the driving unit to transfer the buffered switching duty cycle signal to a corresponding switch.

The light emitting diode driving apparatus may further include a control unit controlling the setting of the switching duty cycle of the driving unit according to the digital value from the converting unit.

The control unit may include a driving controller controlling the setting of the switching duty cycle of the driving unit according to the digital values from the converting unit.

The control unit may further include a converting controller controlling the setting of driving power of the direct current to direct current converting unit according to light emitting diode channel information from the driving controller.

According to another aspect of the present invention, there is provided a light emitting diode driving apparatus, including: an alternating current to direct current converting unit converting input alternating current power into direct current power having a preset voltage level; a direct current to direct current converting unit converting the direct current power into settable driving power; a detecting unit detecting voltage drops generated in each of a plurality of light emitting diode channels each having a plurality of light emitting diodes performing a light emitting operation by receiving the driving power; a converting unit converting analog values detected by the detecting unit into digital values; a driving unit differentially setting duty cycles of switching signals in which driving current is allowed to flow in the plurality of respective light emitting diode channels according to the digital values from the converting unit to drive the plurality of light emitting diode channels; and a switching unit selecting a detection value from each of a plurality of detectors to transfer the selected detection value to the converting unit and selecting the digital value from the converting unit to transfer the selected digital value to each of a plurality of drivers.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
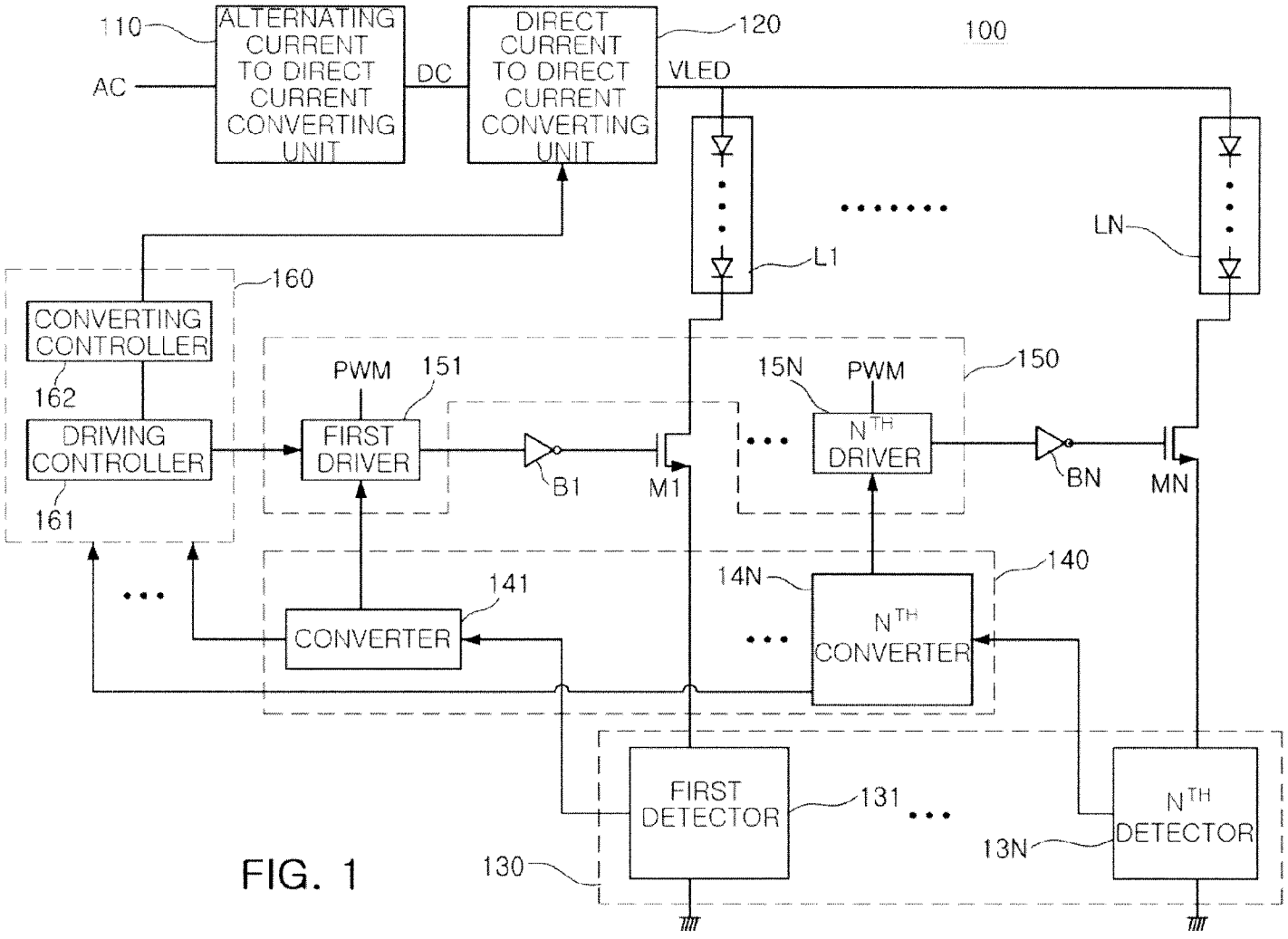
FIG. 1 is a diagram showing a light emitting diode driving apparatus according to an embodiment of the present invention.

Hereinafter, embodiments will be described in detail with reference to the accompanying drawings so that they can be easily practiced by those skilled in the art to which the present invention pertains.

However, in describing embodiments of the present invention, detailed descriptions of well-known functions or constructions will be omitted so as not to obscure the description of the present invention with unnecessary detail.

In addition, like or similar reference numerals denote parts performing similar functions and actions throughout the drawings.

A case in which any one part is connected to the other part includes a case in which the parts are directly connected to each other and a case in which the parts are indirectly connected to each other with other elements interposed therebetween.

In addition, unless explicitly described otherwise, "comprising" any components will be understood to imply the inclusion of other components but not the exclusion of any other components.

Embodiments of the present invention will now be described in detail with reference to the accompanying drawings.

FIG. 1 is a diagram showing a light emitting diode driving apparatus according to an embodiment of the present invention.

Referring to FIG. 1, the light emitting diode driving apparatus 100 according to an embodiment of the present invention may include an alternating current to direct current converting unit 110, a direct current to direct current converting unit 120, a detecting unit 130, a converting unit 140, and a driving unit 150.

The alternating current to direct current converting unit 110 may convert input alternating current power (AC) into direct current power (DC) having a preset voltage level.

The direct current to direct current converting unit 120 may convert the direct current power (DC) from the alternating current to DC converting unit 110 into a driving power having a preset level (VLED) to transfer the driving power having a preset level (VLED) to each of a plurality of light emitting diode channels L1 to LN.

The detecting unit 130 may detect voltage drops of the plurality of light emitting diode channels L1 to LN each having a plurality of light emitting diodes connected in series. The plurality of light emitting diode channels L1 to LN may emit light by receiving the direct current driving power VLED having a preset voltage level, respectively. In this case, each of the light emitting diodes may drop a voltage level of the received power, wherein voltage drop values of the respective light emitting diodes may be different. The detecting unit 130 may detect the voltage drop values of the plurality of light emitting diode channels L1 to LN and include a plurality of detectors 131 to 13N corresponding to the plurality of light emitting diode channels L1 to LN to respectively detect the voltage drop values thereof.

The converting unit 140 may convert analog detection values detected in the detecting unit 130 into digital detection values to transfer the converted digital detection values to the driving unit 150. The converting unit 140 may include a plurality of converters 141 to 14N, wherein the plurality of converters 141 to 14N may respectively correspond to the plurality of detectors 131 to 13N and a plurality of drivers 151 to 15N and convert the analog detection value from a corresponding detector into the digital detection value to transfer the converted digital detection value to a corresponding driver. In addition, the detection value of each of the plurality of converter 141 to 14N may also be transferred to the control unit 160.

The driving unit 150 may set a switching duty cycle controlling driving of the plurality of light emitting diode channels L1 to LN according to the digital detection values from the converting unit 140 and may transfer a switching signal having the set switching duty cycle to the plurality of light emitting diode channels L1 to LN.

To this end, the driving unit 150 may include the plurality of drivers 151 to 15N, wherein the plurality of drivers 151 and 15N may respectively correspond to the plurality of light emitting diode channels L1 to LN such that the switching signal may be transferred to a corresponding light emitting diode channel, L1-LN.

Meanwhile, each of the plurality of drivers 151 to 15N may receive a dimming signal PWM from the outside and drive the plurality of respective light emitting diode channels L1 to LN in the case in which the dimming signal PWM is a switching-on signal.

Each of the plurality of drivers 151 to 15N may set a switching duty cycle according to the digital detection value detected in a corresponding light emitting diode channel, L1-LN. More specifically, each of the plurality of drivers 151 to 15N may lengthen a switching-on duty cycle when the voltage drop value of a corresponding light emitting diode channel, L1-LN, is large, and may set the switching-on duty cycle so as to be short when the voltage drop value of the corresponding light emitting diode channel, L1-LN, is relatively small.

Accordingly, the plurality of light emitting diode channels L1 to LN may have uniform brightness, and heat generated due to a voltage drop deviation between the plurality of light emitting diode channels L1 to LN may be reduced. In addition, the heat may be reduced as described above, whereby the light emitting diode driving apparatus according to the embodiment of the present invention may be implemented by at least one integrated circuit.

The control unit 160 may control setting of a switching-on/off duty cycle of the driver, 151 to 15N, of a corresponding light emitting diode channel of the plurality of light emitting diode channels L1 to LN, based on each of the detection values from the converting unit 140. Therefore, the control unit 160 may include a driving controller 161 controlling the setting of the switching on/off duty cycle of a corresponding driver, one of 151 to 15N, of the corresponding light emitting diode channel, one of L1 to LN, based on each of the detection value from the converting unit 140. In addition, the control unit 160 may further include a converting controller 162 controlling power conversion of the direct current to direct current converting unit 120, based on each of the detection values of the converting unit 140, received from the driving controller 161.

The driving controller 161 may have a protection function limiting an abnormal operation such as open-circuit, short-circuit, or the like, of the light emitting diode channel according to the detection value. That is, in the case in which the light emitting diodes connected in series in the light emitting channel are short-circuited, since the light emitting diodes are directly connected to each other without drop voltage VF, the detection voltage may be increased as compared to the case in which all of the light emitting diodes are normal. An upper reference limit of the detection voltage may be set according to the above-mentioned content, and thus, the case in which the detection voltage is higher than the upper reference limit may be sensed, whereby the short-circuit of the light emitting diode may be recognized. Similarly, in the case in which the light emitting diodes connected in series are open-circuited, since current may not flow therein, the detection voltage may be lowered to be close to a ground. In this case, a lower limit reference may be set and the case in which the detection voltage is lower than the lower limit reference may be sensed, whereby the open-circuit of the light emitting diode may be recognized.

More specifically, a reference with regard to a lower limit value of a duty cycle occurring when the light emitting diode is open-circuited may be set, and it may be sensed that the light emitting diode is open-circuited in the case in which a duty cycle is smaller than the reference. In addition, a reference with regard to an upper limit value of a duty cycle occurring when the light emitting diode is open-circuited may be set, and it may be sensed that the light emitting diode is open-circuited in the case in which a duty cycle is larger than the reference.

In order to perform this process, a magnitude of the duty cycle (D) needs to be sensed initially and performed by using an internal clock of the light emitting diode (here, as the internal clock, a clock significantly faster than a frequency of the light emitting diode driving channel is used). The duty cycle may be recognized by using a digital counting method using the internal clock during a period in which the light emitting diode of the channel is turned on, that is, a turn-on duty cycle. In addition, the driving controller 161 may be less affected by signal noise by processing this signal transfer relationship as a digital signal and convert each of the digital detection values of the plurality of converter 141 to 14N into analog detection values to transfer the analog detection values to the converting controller 162.

Viewing the entire signal transfer route of the light emitting diode driving apparatus according to the embodiment of the present invention, information of the light emitting diode channels L1 to LN may be converted from the analog-type into the digital-type, again converted from the digital-type into the analog-type, and then used for a power conversion control of the direct current to direct current converting unit 120, whereby a stable operation may be performed without responding to rapid signal conversion.

The light emitting diode driving apparatus according to the embodiment of the present invention may further include a plurality of switches M1 to MN. Each of the plurality of switches M1 to MN may be connected between the plurality of respective light emitting diode channels L1 to LN and the ground and be switched on or switched off according to the switching signal from the driving unit 150 to allow current to flow in the corresponding light emitting diode channel, L1-LN or block the current flowing in the corresponding light emitting diode channel, L1-LN. In addition, the light emitting diode driving apparatus according to the embodiment of the present invention may further include a plurality of buffers B1 to BN each buffering the switching signal from each of the plurality of drivers 151 to 15N to transfer the buffered switching signal to a corresponding switch, M1-MN.

Figure 2:
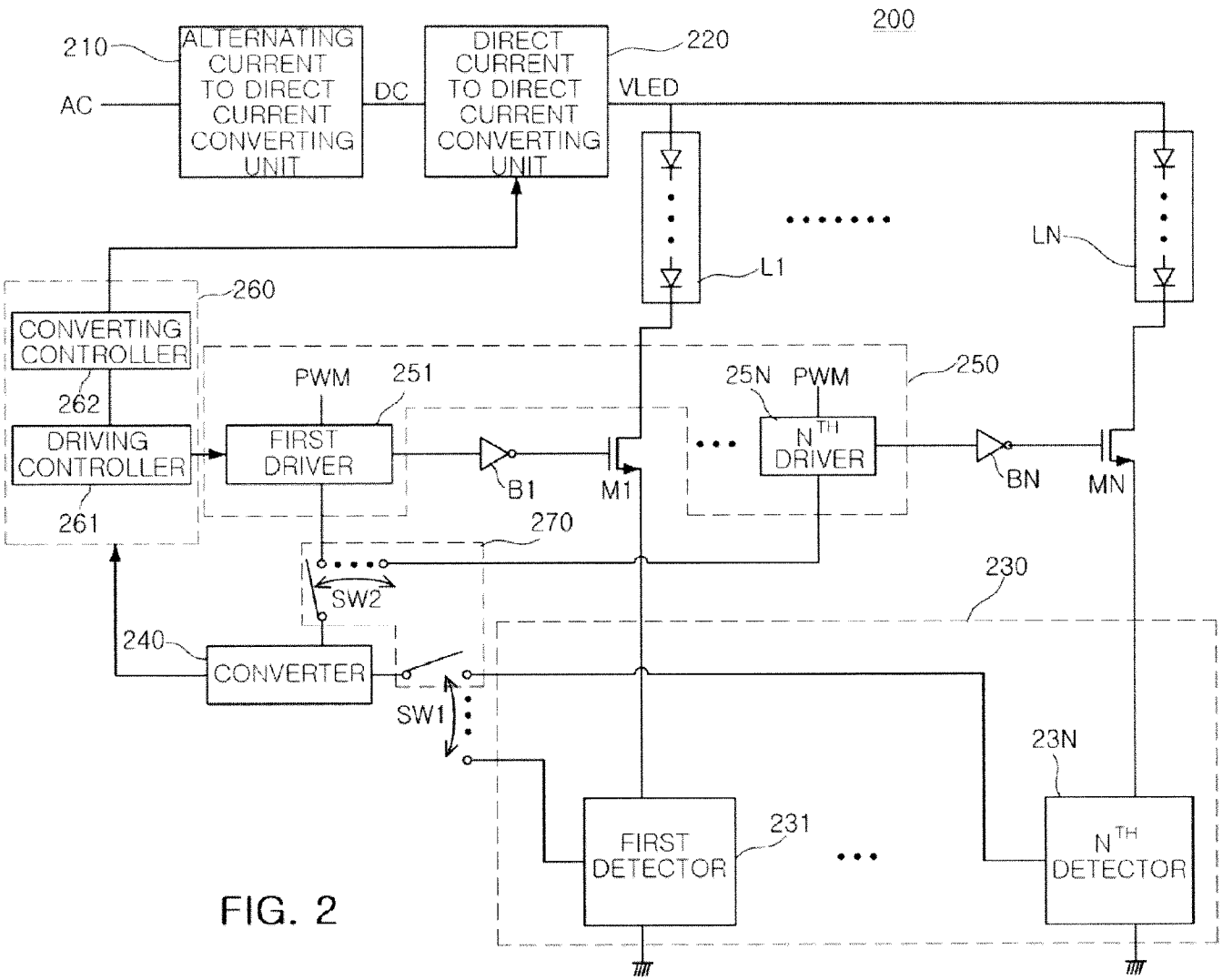
FIG. 2 is a diagram showing alight emitting diode driving apparatus according to another embodiment of the present invention.

FIG. 2 is a diagram showing a light emitting diode driving apparatus according to another embodiment of the present invention.

Referring to FIG. 2, a light emitting diode driving apparatus 200 according to another embodiment of the present invention may include a switching unit 270. The switching unit 270 may include a first selection switch SW1 and a second selection switch SW2, wherein the first selection switch SW1 may selectively connect a converting unit 240 and a plurality of detectors 231 to 23N, and the second selection switch SW 2 may selectively connect the converting unit 240 and a plurality of drivers 251 to 25N. Therefore, the number of converting units 240 may not be plural. Meanwhile, an alternating current to direct current converting unit 210, a direct current to direct current converting unit 220, a detecting unit 230, a driving unit 250, and a control unit 260 are same as the alternating current to direct current converting unit 110, the direct current to direct current converting unit 120, the detecting unit 130, the driving unit 150, and the control unit 160 described with reference to FIG. 1. Therefore, a detailed description thereof will be omitted.

Figure 3:
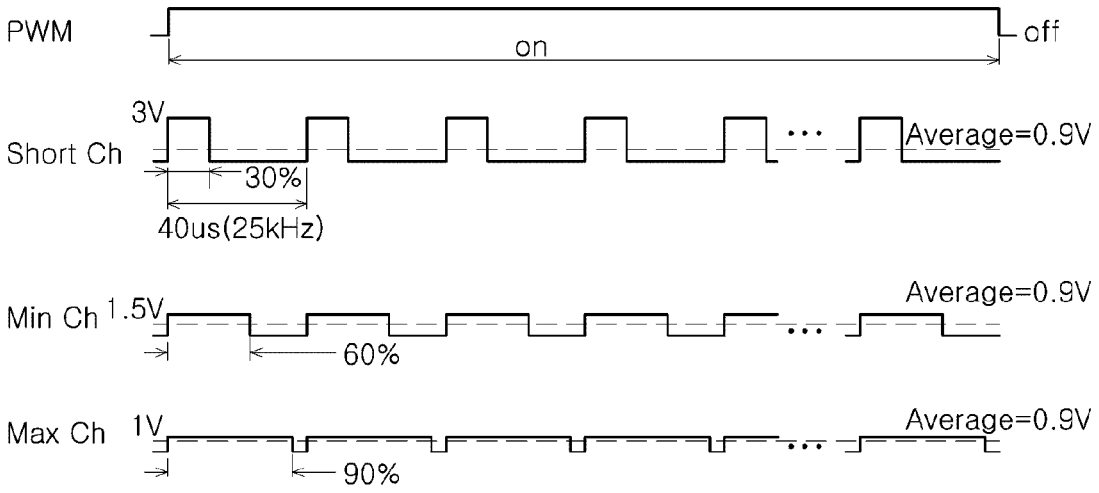
FIG. 3 is a graph showing an operation of the light emitting diode driving apparatus according to the embodiment of the present invention.

FIG. 3 is a graph showing an operation of the light emitting diode driving apparatus according to the embodiment of the present invention.

Referring to FIGS. 1 and 3, only when the dimming signal PWM from the outside is switched on, the driving unit 150 may transfer the switching signal to a corresponding light emitting diode channel, L1-LN. In this case, as the voltage drop (1.5V) of the corresponding light emitting diode channel, L1-LN exceeds a preset reference voltage level, the switching-on duty cycle in which the switches M1 to MN are switched on may be set to be long, for example, about 90%, and as the voltage drop (1V) of the corresponding light emitting diode channel, L1-LN, is lower than the preset reference voltage level, the switching-on duty cycle in which the switches M1 to MN are switched on may be set to be short, for example, about 60% (Min Ch, Max Ch). That is, the switching-on duty cycle of the switching signal of the corresponding light emitting diode channel may be variably set according to a variation in voltage drops in the corresponding light emitting diode channel. Therefore, the average current flowing in the light emitting diode channels L1 to LN is uniformly maintained (as represented by a voltage of 0.9V), whereby the plurality of light emitting diode channels L1 to LN may have uniform brightness and the heat generated due to the voltage drop deviation between the plurality of light emitting diode channels L1 to LN may be reduced. In addition, in the case in which the short-circuit occurs in at least one of the plurality of light emitting diode channels L1 to LN, since the voltage drop is increased (3V), the switching-on duty cycle is set to be significantly short, for example, 30%, according to voltage drops in corresponding light emitting diode channel, whereby the heat may be reduced.

The operation graph of FIG. 3 may be similarly applied to the light emitting diode driving apparatus 200 according to another embodiment of the present invention of FIG. 2.

Figure 4:
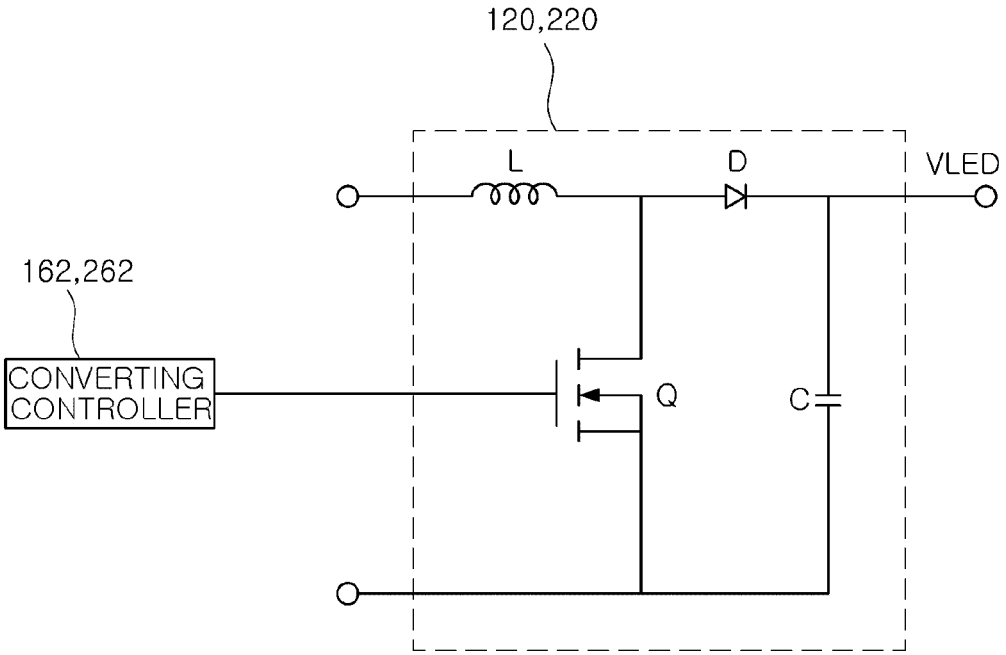
FIG. 4 is a schematic configuration diagram of a direct current (DC) to DC converting unit controlled by a control unit used in the light emitting diode driving apparatus according to the embodiment of the present invention.

FIG. 4 is a schematic configuration diagram of a direct current (DC) to DC converting unit controlled by a control unit used in the light emitting diode driving apparatus according to the embodiment of the present invention.

Referring to FIG. 4, the converting controller 162 or 262 of the control unit 160 or 260 used in the light emitting diode driving apparatus may control the switching-on/off of the switch Q of the direct current to direct current converting unit 120 based on each of the detection values of the converting unit 140 received from the driving controller 161. The direct current to direct current converting unit 120 may further include an inductor L accumulating energy therein and discharging the energy therefrom according to the switching-on/off of the switch Q, a diode D providing a route, and a capacitor C stabilizing the driving power VLED.

According to the embodiments of the present invention, the switching-on duty cycles in which the driving current is allowed to flow in respective LED channels may be differentially set according to the voltage deviation between the LED channels, whereby the heat generated due to the voltage deviation between the LED channels may be reduced, the brightness in the LED channels may be uniformly maintained, and the light emitting diode driving apparatus may be implemented by one integrated circuit.

As set forth above, according to the embodiments of the present invention, the duty cycles in which the driving current is allowed to flow in each of the LED channels are differentially set according to the voltage deviation between the LED channels, whereby the average current of the LED channels may be uniformly maintained and the heat generated due to the voltage deviation between the LED channels may be reduced.

While the present invention has been shown and described in connection with the embodiments, it will be apparent to those skilled in the art that modifications and variations can be made without departing from the spirit and scope of the invention as defined by the appended claims.

What is claimed is:

1. A light emitting diode driving apparatus, comprising:

an alternating current to direct current converting unit converting input alternating current power into direct current power having a preset voltage level;

a direct current to direct current converting unit converting the direct current power into a settable driving power provided to each of a plurality of light emitting diode channels each having a plurality of light emitting diodes performing a light emitting operation by receiving the driving power;

a detecting unit detecting voltage drops generated in the plurality of respective light emitting diode channels in response to receiving the driving power;

a converting unit converting an analog value detected by the detecting unit into a digital value;

a driving unit differentially setting duty cycles of switching signals controlling time periods in which driving current is allowed to flow in each respective one of the plurality of light emitting diode channels according to the digital values from the converting unit to drive the plurality of light emitting diode channels.

2. The light emitting diode driving apparatus of claim 1, wherein the detecting unit includes a plurality of detectors respectively corresponding to the plurality of light emitting diode channels and detecting the voltage drops in a corresponding light emitting diode channel.

3. The light emitting diode driving apparatus of claim 2, wherein the driving unit includes a plurality of drivers respectively corresponding to the plurality of light emitting diode channels and setting the duty cycles of the switching signals by which the driving current is allowed to flow in a corresponding light emitting diode channel to thereby be driven.

4. The light emitting diode driving apparatus of claim 3, wherein the converting unit includes a plurality of converters respectively corresponding to the plurality of detectors and converting the analog value detected by each of the plurality of detectors into the digital value to transfer the converted digital value to a corresponding driver among the plurality of drivers.

5. The light emitting diode driving apparatus of claim 1, wherein the driving unit sets a switching-on duty cycle so as to be long when the voltage drop exceeds a reference voltage and the switching-on duty cycle so as to be shortened when the voltage drop is lower than the reference voltage.

6. The light emitting diode driving apparatus of claim 1, wherein the detecting unit, the converting unit, and the driving unit are configured by at least one integrated circuit.

7. The light emitting diode driving apparatus of claim 1, further comprising a plurality of switches respectively connected between each of the plurality of light emitting diode channels and a ground, and turned on and turned off according to the switching duty cycle set by the driving unit to drive the corresponding light emitting diode channel.

8. The light emitting diode driving apparatus of claim 7, further comprising a plurality of buffers buffering a switching duty cycle signal from the driving unit to transfer the buffered switching duty cycle signal to a corresponding switch.

9. The light emitting diode driving apparatus of claim 1, further comprising a control unit controlling the setting of the switching duty cycle of the driving unit according to the digital value from the converting unit.

10. The light emitting diode driving apparatus of claim 9, wherein the control unit includes a driving controller controlling the setting of the switching duty cycle of the driving unit according to the digital value from the converting unit.

11. The light emitting diode driving apparatus of claim 10, wherein the control unit further includes a converting controller controlling the setting of driving power of the direct current to direct current converting unit according to light emitting diode channel information from the driving controller.

12. The light emitting diode driving apparatus of claim 11, wherein the converting controller controls the setting of driving power of the direct current to direct current converting unit by controlling the switching-on and switching-off of a switch of the direct current to direct current converting unit according to light emitting diode channel information from the driving controller.

13. A light emitting diode driving apparatus, comprising:

an alternating current to direct current converting unit converting input alternating current power into direct current power having a preset voltage level;

a direct current to direct current converting unit converting the direct current power into a settable driving power provided to each of a plurality of light emitting diode channels each having a plurality of light emitting diodes performing a light emitting operation by receiving the driving power;

a detecting unit detecting voltage drops generated in each of the plurality of light emitting diode channels in response to the driving power;

a converting unit converting analog values detected by the detecting unit into digital values;

a driving unit differentially setting duty cycles of switching signals controlling time periods in which driving current is allowed to flow in each respective one of the plurality of light emitting diode channels according to the digital values from the converting unit to drive the plurality of light emitting diode channels; and a switching unit selecting a detection value having detected the voltage drops generated in each of the plurality of light emitting diode channels to transfer the selected detection value to the converting unit and selecting the digital value from the converting unit to transfer the selected digital value to the driving unit.

14. The light emitting diode driving apparatus of claim 13, wherein the detecting unit includes a plurality of detectors respectively corresponding to the plurality of light emitting diode channels and detecting voltage drops in a corresponding light emitting diode channel.

15. The light emitting diode driving apparatus of claim 14, wherein the driving unit includes a plurality of drivers respectively corresponding to the plurality of light emitting diode channels and setting the duty cycles of the switching signals in which the driving current is allowed to flow in the corresponding light emitting diode channel to thereby be driven.

16. The light emitting diode driving apparatus of claim 15, wherein the converting unit includes a plurality of converters corresponding to the plurality of detectors, and converting the analog value detected by each of the plurality of detectors into the digital value to transfer the converted digital value to a corresponding driver among the plurality of drivers.

17. The light emitting diode driving apparatus of claim 15, wherein the switching unit includes:

a first selection switch selecting the detection value from each of the plurality of detectors to transfer the selected detection value to the converting unit; and a second selection switch selecting the digital value from the converting unit to transfer the selected digital value to each of the plurality of drivers.

18. The light emitting diode driving apparatus of claim 13, wherein the driving unit sets a switching-on duty cycle so as to be long when the voltage drop exceeds a reference voltage and the switching-on duty cycle to be shortened when the voltage drop is lower than the reference voltage.

19. The light emitting diode driving apparatus of claim 13, wherein the detecting unit, the converting unit, and the driving unit are configured by at least one integrated circuit.

20. The light emitting diode driving apparatus of claim 13, further comprising a plurality of switches respectively connected between each of the plurality of light emitting diode channels and a ground and turned on and turned off according to the switching duty cycle set by the driving unit to drive the corresponding light emitting diode channel.

21. The light emitting diode driving apparatus of claim 20, further comprising a plurality of buffers buffering a switching duty cycle signal from the driving unit to transfer the buffered switching duty cycle signal to a corresponding switch.

22. The light emitting diode driving apparatus of claim 13, further comprising a control unit controlling the setting of the switching duty cycle of the driving unit according to the digital value from the converting unit.

23. The light emitting diode driving apparatus of claim 22, wherein the control unit includes a driving controller controlling the setting of the switching duty cycle of the driving unit according to the digital value from the converting unit.

24. The light emitting diode driving apparatus of claim 23, wherein the control unit further includes a converting controller controlling the setting of driving power of the direct current to direct current converting unit according to light emitting diode channel information from the driving controller.

* * * * *